US006874861B2

(12) United States Patent
Farr et al.

(10) Patent No.: US 6,874,861 B2
(45) Date of Patent: Apr. 5, 2005

(54) PRINTING DEVICE HAVING A PRINTING FLUID DETECTION SYSTEM

(75) Inventors: Isaac Farr, Corvallis, OR (US); Shane Shivji, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 44 days.

(21) Appl. No.: 10/425,788

(22) Filed: Apr. 29, 2003

(65) Prior Publication Data

US 2004/0218000 A1 Nov. 4, 2004

(51) Int. Cl.[7] ..... B41J 29/393
(52) U.S. Cl. ..... 347/19
(58) Field of Search ..... 347/5–7, 19, 95, 347/85, 86, 92, 93; 101/364; 200/61.04

(56) References Cited

U.S. PATENT DOCUMENTS 4,183,029 A * 1/1980 Isayama et al. ..... 347/93
4,202,267 A * 5/1980 Heinzl et al. ..... 101/364
4,319,484 A 3/1982 Keller ..... 73/304 C
4,368,478 A * 1/1983 Koto ..... 347/86
4,445,012 A * 4/1984 Blackburn et al. ..... 200/61.04
4,800,755 A 1/1989 Fathauer et al. ..... 73/304 C
4,841,256 A 6/1989 Gastgeb ..... 331/25
4,956,763 A 9/1990 Stewart, Jr. et al. ..... 700/34
5,611,240 A 3/1997 Yamaguchi ..... 73/304 C
5,623,291 A * 4/1997 Morandotti et al. ..... 347/7
5,682,184 A * 10/1997 Stephany et al. ..... 347/7
5,719,556 A 2/1998 Albin et al. ..... 340/618
6,246,831 B1 6/2001 Seitz et al. ..... 392/486

* cited by examiner

*Primary Examiner*—Hai Pham

(57) ABSTRACT

A printing device is provided, which is configured to print a printing fluid onto a printing medium. The printing device includes a printing fluid reservoir configured to hold a volume of the printing fluid, a print head assembly configured to transfer the printing fluid to the printing medium, a conduit fluidically connecting the printing fluid reservoir to the print head assembly, and a printing fluid detector associated with the conduit. The printing fluid detector includes a first electrode and a second electrode coupled with the conduit and configured to be in contact with printing fluid in the conduit, a power supply configured to apply an alternating supply signal to the first electrode, and detector circuitry configured to detect a measured impedance value related to the presence of printing fluid within the conduit by comparing the alternating supply signal with a detected signal that has been modified from the applied signal by an impedance characteristic of the printing fluid.

67 Claims, 6 Drawing Sheets

30
34
36
35
32

66
60'
34
62
36
62
68
60
32
64

70
7
74
72
7

76'
80
76
74
72
70

PRINTING DEVICE HAVING A PRINTING FLUID DETECTION SYSTEM

BACKGROUND

Many types of printing devices, including but not limited to printers, copiers, and facsimile machines, print by transferring a printing fluid onto a printing medium. These printing devices typically include a printing fluid supply or reservoir configured to store a volume of printing fluid. The printing fluid reservoir may be located remotely from the print head assembly ("off-axis"), in which case the fluid is transferred to the print head assembly through a suitable conduit, or may be integrated with the print head assembly ("on-axis"). Where the printing fluid reservoir is located off-axis, the print head assembly may include a small reservoir that is periodically refilled from the larger off-axis reservoir.

Some printing devices may include a printing fluid detector configured to produce an out-of-fluid signal when printing fluid in the print head assembly or printing fluid reservoir drops below a predetermined level. This signal may be used to trigger the printing device to stop printing, and also to alert a user to the out-of-fluid state. The user may then replace (or replenish) the printing fluid reservoir and resume printing.

Various types of printing fluid detectors are known. Examples include, but are not limited to, optical detectors, pressure-based detectors, resistance-based detectors and capacitance-based detectors. Capacitance-based printing fluid detectors may utilize a pair of capacitor plates positioned adjacent, but external, to the printing fluid. These detectors measure changes in the capacitance of the plates with changes in printing fluid levels. However, the changes in capacitance of these systems may be too small to easily distinguish the capacitance changes from background noise. Thus, it may be difficult to accurately determine a printing fluid level, resulting in the generation of false out-of-fluid signals, and/or the failure to generate out-of-fluid signals when appropriate. Furthermore, many of these detectors may have difficulty distinguishing printing fluid from printing fluid froth, which is commonly dispensed by a printing fluid reservoir after the reservoir is substantially emptied of printing fluid.

SUMMARY

A printing device is provided, which is configured to print a printing fluid onto a printing medium. The printing device includes a printing fluid reservoir configured to hold a volume of the printing fluid, a print head assembly configured to transfer the printing fluid to the printing medium, a conduit fluidically connecting the printing fluid reservoir to the print head assembly, and a printing fluid detector associated with the conduit. The printing fluid detector includes a first electrode and a second electrode coupled with the conduit and configured to be in contact with printing fluid in the conduit, a power supply configured to apply an alternating supply signal to the first electrode, and detector circuitry configured to detect a measured impedance value related to the presence of printing fluid within the conduit by comparing the alternating supply signal with a detected signal that has been modified from the applied signal by an impedance characteristic of the printing fluid.

DETAILED DESCRIPTION

Figure 1:
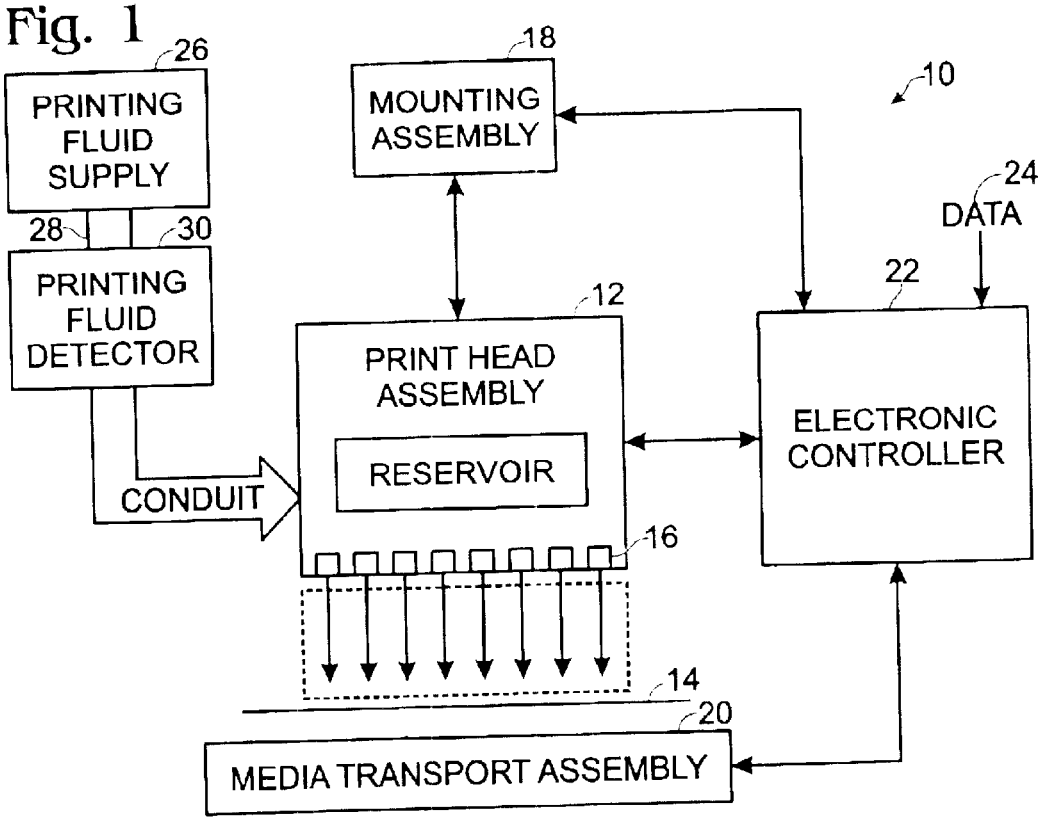
FIG. 1 is a block diagram of a printing device according to a first embodiment of the present invention.

FIG. 1 shows, generally at 10, a block diagram of a first embodiment of a printing device according to the present invention. Printing device 10 may be any suitable type of printing device, including but not limited to, a printer, facsimile machine, copier, or a hybrid device that combines the functionalities of more than one of these devices. Printing device 10 includes a print head assembly 12 configured to transfer a printing fluid onto a printing medium 14 positioned adjacent to the print head assembly. Print head assembly 12 typically is configured to transfer the printing fluid onto printing medium 14 via a plurality of fluid ejection mechanisms 16. Fluid ejection mechanisms 16 may be configured to eject printing fluid in any suitable manner. Examples include, but are not limited to, thermal and piezoelectric fluid ejection mechanisms.

Print head assembly 12 may be mounted to a mounting assembly 18 configured to move the print head assembly relative to printing medium 14. Likewise, printing medium 14 may be positioned on, or may otherwise interact with, a media transport assembly 20 configured to move the printing medium relative to print head assembly 12. Typically, mounting assembly 18 moves print head assembly 12 in a direction generally orthogonal to the direction in which media transport assembly 20 moves printing medium 14, thus enabling printing over a wide area of printing medium 14.

Printing device 10 also typically includes an electronic controller 22 configured receive data 24 representing a print job, and to control the ejection of printing fluid from print head assembly 12, the motion of mounting assembly 18, and the motion of media transport assembly 20 to effect printing of an image represented by data 24.

Printing device 10 also includes a printing fluid reservoir 26 configured to supply printing fluid stored within the printing fluid reservoir to print head assembly 12 as needed. Printing fluid reservoir 26 is fluidically connected to print head assembly 12 via a conduit 28 configured to transport printing fluid from the printing fluid reservoir to the print head assembly. Any of print head assembly 12, printing fluid reservoir 26, or conduit 28 may include a suitable pumping mechanism (not shown) for effecting the transfer of printing fluid from the printing fluid reservoir to the print head assembly. Examples of suitable pumping devices include, but are not limited to, peristaltic pumping devices.

Printing fluid reservoir 26 may be configured to deliver printing fluid to print head assembly 12 continuously during printing, or may be configured to periodically deliver a predetermined volume of printing fluid to the print head assembly. Where printing fluid reservoir 26 is configured to deliver a predetermined volume of printing fluid to print head assembly 12 periodically, the print head assembly may include a smaller reservoir 29 configured to hold printing fluid transferred from printing fluid reservoir 26.

Printing device 10 also includes a printing fluid detector 30 disposed along conduit 28 between printing fluid reservoir 26 and print head assembly 12. Printing fluid detector 30 is configured to measure an impedance value associated with the printing fluid in conduit 28, and to determine a characteristic of the printing fluid in the conduit based upon the measured impedance value. For example, printing fluid detector 30 may be configured to determine a type of printing fluid in conduit 28, and/or whether any printing fluid is in the conduit.

Figure 2:
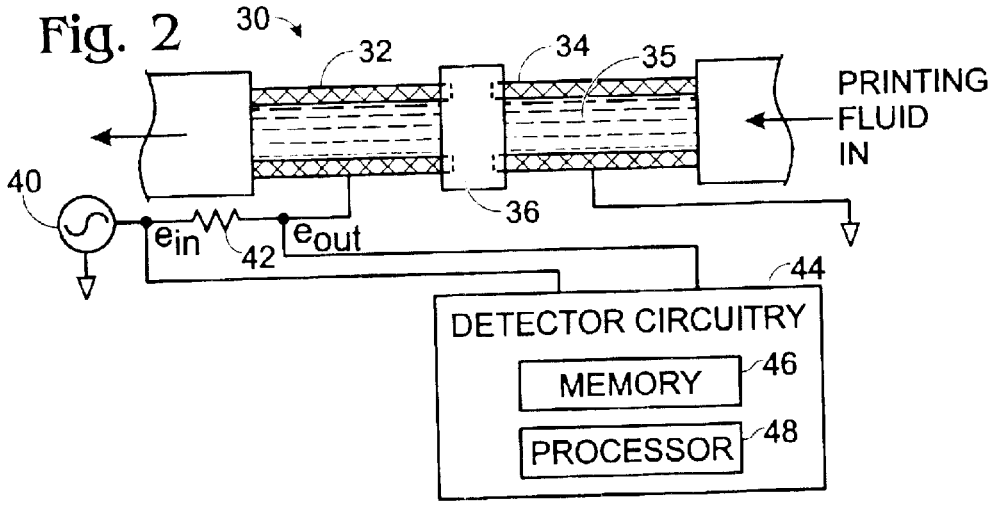
FIG. 2 is a schematic depiction of a first embodiment of the printing fluid detector of the printing device of FIG. 1, with the detector filled completely with printing fluid.

FIG. 2 shows a schematic depiction of a first exemplary embodiment of printing fluid detector 32. Printing fluid detector 30 includes a first electrode 32 and a second electrode 34. Each electrode has a hollow interior through which printing fluid may flow, and solid walls configured to contain the printing fluid within the hollow interior, and thus forms a portion of conduit 28. First electrode 32 and second electrode 34 are each electrically conductive, and are separated by an electrically insulating conduit segment 36. First electrode 32 and second electrode 34 are arranged in the conduit such that printing fluid 35 flowing from printing fluid reservoir 26 into print head assembly 12 first flows through one of the electrodes, then through electrically insulating conduit segment 36, and then through the other electrode before reaching the print head assembly. In FIG. 2, printing fluid is depicted as flowing first through second electrode 34. However, it Will be appreciated that printing fluid may also flow first through first electrode 32.

Printing fluid detector 30 also includes power supply circuitry 40 configured to apply an alternating signal to the first electrode or second electrode (or, equivalently, across the first and second electrodes). A resistor 42 is disposed between power supply circuitry 40 and first electrode 32, in series with first electrode 32 and second electrode 34.

Additionally, printing fluid detector 30 includes detector circuitry 44 configured to determine a measured impedance value of the printing fluid from a comparison of the supply signal measured at $e_{in}$ and a detected signal measured at $e_{out}$. As shown in FIG. 2, $e_{in}$ may be measured at the power supply side of resistor 42, and $e_{out}$ may be measured at the side of resistor 54 closer to first electrode 32. The measured impedance value, either a capacitance value or a resistance value, may then be used to determine a characteristic of printing fluid 42 in printing fluid reservoir 26, including but not limited to, a printing fluid type and an out-of-fluid condition. Furthermore, where the rate of transfer of printing fluid from printing fluid reservoir 26 to print head assembly 12 is known, a printing fluid level in printing fluid reservoir 26 may also be determined. These determinations are described in more detail below.

Detector circuitry 44 may include a memory 46 and a processor 48 for comparing the supply signal and the detected signal to determine the measured impedance value. Memory 46 may be configured to store instructions executable by processor 48 to perform the comparison of the supply signal and detected signal to determine the measured impedance value. The instructions may also be executable by processor 48 to compare the measured impedance value to predetermined impedance values arranged in a look-up table also stored in memory 46 to determine the desired characteristic of the printing fluid in conduit 28.

First electrode 32 and second electrode 34 are each configured such that the electrically conductive materials that form the first and second electrodes are in direct contact with printing fluid when the printing fluid is in the conduit. In some capacitive fluid level detection systems, the capacitor plates may be positioned externally from the fluid being measured. However, as described above, the changes in capacitance due to a presence or absence of printing fluid in these systems may be too small to easily distinguish the changes from background noise.

Figure 3:
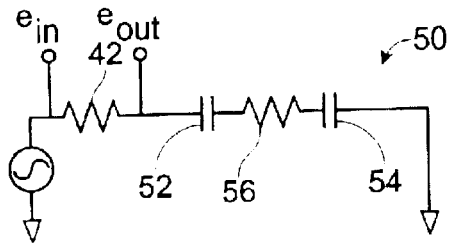
FIG. 3 is a schematic depiction of an equivalent circuit of the embodiment of FIG. 2.

In contrast, by placing first electrode 32 and second electrode 34 in direct contact with the printing fluid, extremely large capacitances may be formed. When two electrodes are placed in an ionic fluid, such as many printing fluids, and charged with opposite polarities, a layer of negative ions forms on the positively charged electrode, and a layer of positive ions forms on the negatively charged electrode. Furthermore, additional layers of positive and negative ions form on the innermost ion layers, forming alternating layers of oppositely charged ions extending outwardly into the printing fluid from each electrode. This charge structure is referred to as an electrical double layer (EDL), due to the double charge layer represented by the charges in the electrode and the charges in the first ion layer on the electrode surface. The EDL at each electrode acts effectively a capacitor, wherein the layer of ions acts as one plate and the electrode acts as the other plate. The effective circuit of the electrodes in the solution is shown generally at 50 in FIG. 3, wherein capacitor 52 represents the EDL at first electrode 32, and capacitor 54 represents the EDL at second electrode 44. The printing fluid will also have an associated resistance, represented by resistor 55.

Due to the atomic-scale proximity of the ions to the electrode in the EDL, and to the fact that capacitance varies inversely with the distance of charge separation in a capacitor, extremely large capacitances per unit electrode surface area are generated in the EDLs associated with electrodes 32 and 34. The capacitances may be orders of magnitude larger than those possible with electrodes located external to the printing fluid. For example, where the surface areas and separation of first electrode 32 and second electrode 34 would be expected to result in a capacitance in the femptofarad range, capacitances in the nanofarad or microfarad range are observed. These large capacitances facilitate the measurement of the impedance of the printing fluid in conduit 28.

Figures 4, 5, 6, 7:
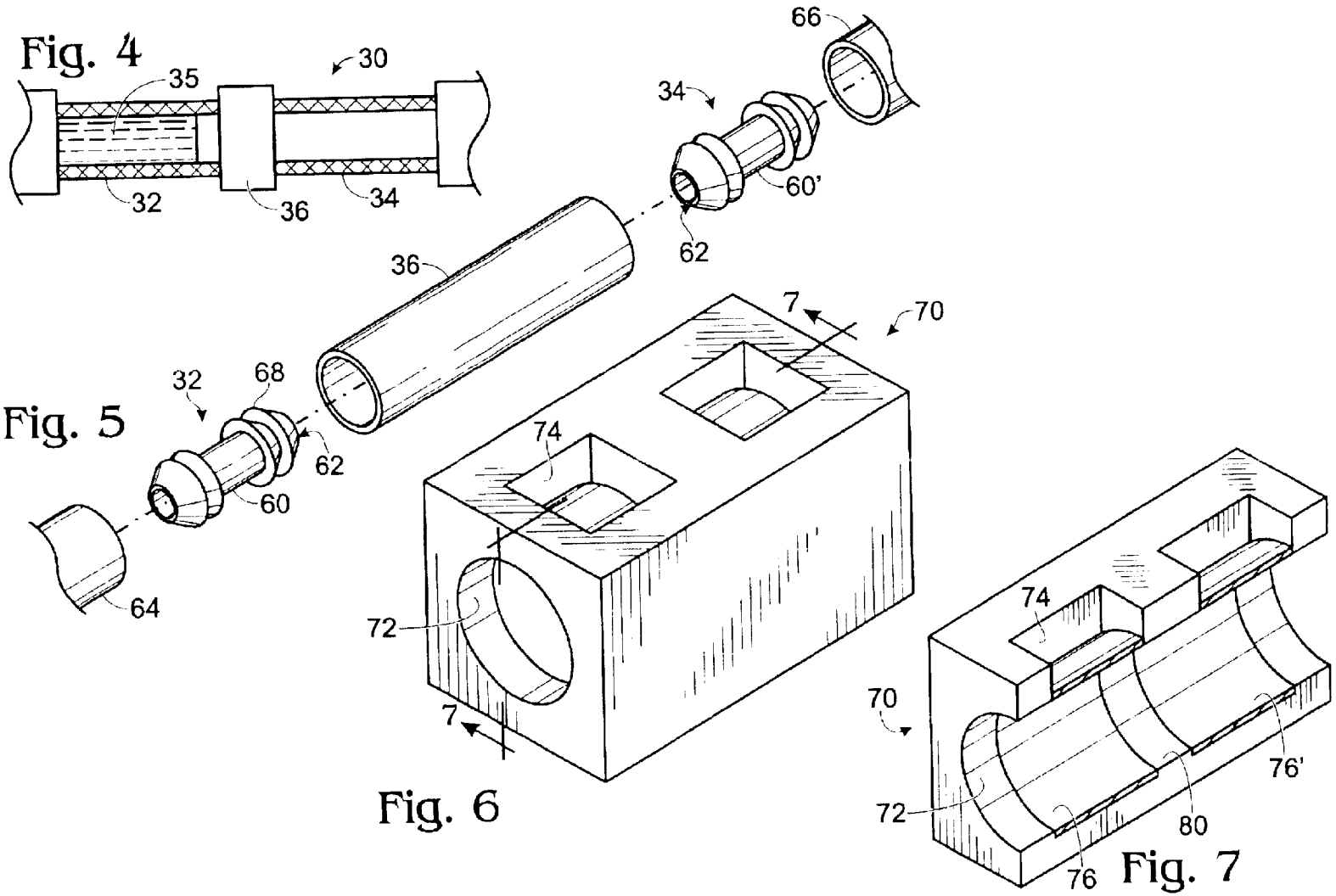
FIG. 4 is a schematic depiction of the embodiment of FIG. 2, with the detector partially drained of printing fluid.
FIG. 5 is an isometric view of a first exemplary embodiment of the printing fluid detector of FIG. 2.
FIG. 6 is an isometric view of a second exemplary embodiment of the printing fluid detector of FIG. 2.
FIG. 7 is a broken-away view of the embodiment of FIG. 6, taken along line 7—7 of FIG. 6.

Likewise, when conduit 28 is drained of printing fluid, much lower capacitances are observed. FIG. 4 shows the printing fluid detector of FIG. 3 drained of sufficient printing fluid such that second electrode 34 is not in contact with any printing fluid. In this instance, no EDL exists on the surface of second electrode 34. Thus, the capacitance of electrodes 32 and 34 is lower than when both electrodes are in contact with printing fluid. The drop in capacitance may be significant and easily distinguishable from noise. Thus, this difference in capacitance may be used to detect an out-of-fluid condition within the conduit, and thus an out-of-fluid condition in printing fluid reservoir 26.

First electrode 32 and second electrode 34 may each have any suitable shape and size. FIG. 5 shows a first exemplary embodiment of first electrode 32 and second electrode 34, in which each electrode takes the form of an electrically conductive cylinder, indicated at 60 and 60' for the first and second electrodes, respectively. Each cylinder 60 (and 60') includes an end 62 configured to fit snugly within the inner diameter of electrically insulating conduit segment 36. Also, cylinder 60 includes a second end configured to fit within conduit segment 64, which leads toward printing fluid reservoir 26, and cylinder 60' includes a second end configured to fit within conduit segment 66, which leads to print head assembly 12. Cylinders 60, 60' also include electrical connections (not shown) to detector circuitry 44.

Each end 62 of each cylinder 60, 60' may include one or more barbs 68 to hold the end securely within the interior of the adjacent conduit segment. Alternatively, ends 62 may be connected to conduit segments 36, 64 and 66 via an adhesive, a clamp, and/or any other suitable attachment mechanism. Likewise, the ends of each cylinder 60, 60' may be configured to fit over adjacent conduit segments such that the conduit segments fit within the interior of the cylinders.

Cylinders 60, 60' may have any suitable dimensions. For example, each cylinder 60, 60' may have an inner diameter of approximately 0.5–5.0 mm, and more typically approximately 1 mm. A cylinder 60 with an inner diameter in this range may help to ensure that printing fluid remains in contact with all inner surfaces of the cylinder while inside of the cylinder, and thus to help ensure the proper functioning of printing fluid detector 32. Likewise, each cylinder 60, 60' may have any suitable length. Suitable lengths include, but are not limited, to those in the range of approximately 10 mm to 30 mm. While the depicted cylinders have a generally round cross-sectional shape, it will be appreciated that the cylinders may have any other suitable cross-sectional shape, including, but not limited to, polygonal cross-sections. Thus, the term "cylindrical" as used herein is used only to describe the appearance of the depicted embodiment, and is not intended to be limiting in any sense. Likewise, it will be appreciated that the dimensional ranges stated above are merely exemplary, and that cylinders 60 and 60' may also have dimensions outside of these ranges.

Cylinders 60, 60' may be made of any suitable electrically conductive material. Examples of suitable materials include, but are not limited to, metals such as stainless steel, platinum, gold and palladium. Alternatively, first electrode 32 and second electrode 34 may be made from an electrically conductive carbon material. Examples include, but are not limited to, activated carbon, carbon black, carbon fiber cloth, graphite, graphite powder, graphite cloth, glassy carbon, carbon aerogel, and cellulose-derived foamed carbon. To increase the conductivity of a carbon-based electrode, the carbon may be modified by oxidation. Examples of suitable techniques to oxidize the carbon include, but are not limited to, liquid-phase oxidations, gas-phase oxidations, plasma treatments, and heat treatments in inert environments.

In some embodiments, first electrode 32 and second electrode 34 may be coated with an electrically conductive coating. For example, first electrode 32 and second electrode 34 may be coated with a material having a high surface area-to-volume ratio to increase the effective surface area of the electrode. This may increase the capacitances that may be achieved with the electrode, as the electrode surface may accommodate more charge. The use of such a coating may allow smaller electrodes to be used without any sacrifice in measurement sensitivity. The use of a coating also may offer the further advantage of protecting the electrode material from corrosion by the printing fluid. Examples of suitable electrically conductive coatings include, but are not limited to, Teflon-based coatings (which may be modified with carbon), polypyrroles, polyanilines, polythiophenes, conjugated bithiazoles and bis-(thienyl) bithiazoles. Furthermore, the coating may be selectively cross linked to reduce the level and type of adsorbed printing fluid components.

FIGS. 6–7 show a second exemplary embodiment of the first electrode, second electrode and electrically insulating conduit segment. Referring first to FIG. 6, the first electrode, second electrode and electrically insulating conduit segment are all integrated into a housing, indicated generally at 70. Housing 70 includes an opening 72 at each end to accept the attachment of conduit 28 and to permit passage of a flow of printing fluid. Housing 72 also may include one or more electrical ports 74 configured to permit electrical connections to be made to first electrode 32 and second electrode 34, which are contained within housing 72. In the depicted embodiment, housing 72 includes two electrical ports 74, one for each electrode contained within. However, it will be appreciated that housing 72 may include either more or fewer electrical ports.

Next, FIG. 7 shows a broken-away view of housing 72 that shows first electrode and second electrode. Each electrode takes the form of an electrically conductive cylinder, indicated at 76 and 76' for the first and second electrodes, respectively. Cylinders 76 and 76' are each seated in a compartment configured to hold the cylinder in place within housing 72. Cylinders 76 and 76' are separated by a separator 80 that holds the cylinders apart from one another at a desired spacing. Separator 80 thus also acts as electrically insulating conduit segment 36' in the embodiment of FIGS. 6–7.

Housing 72 may have any suitable construction. For example, housing 72 may be formed from a molded electrically insulating material, such as a suitable plastic or ceramic, or a machined material. The inner surface of each cylinder 76 and 76' may be flush with the inner surface of separator 78, or may be raised or lowered with respect to the inner surface of the separator. Likewise, cylinders 76 and 76' may be made from any suitable electrically insulating material, including but not limited to those listed above for the embodiment of FIG. 5.

As mentioned above, printing fluid detector 30 may be used either to measure a capacitance value or a resistance value. The determination and use of capacitance measurements are described first. As is well known in the electrical arts, a capacitor may cause a phase shift in an alternating signal, in that the current through the capacitor lags the voltage across the capacitor. This effect is observed with EDL capacitance. The magnitude of the phase shift is a function of both the frequency of the signal and the capacitance of the capacitor. Thus, the phase shift of the supply signal measured at $e_{in}$ relative to the detected signal measured at $e_{out}$ may be used to determine the capacitance of first electrode 32 and second electrode 34 in the presence or absence of printing fluid.

Figure 8:
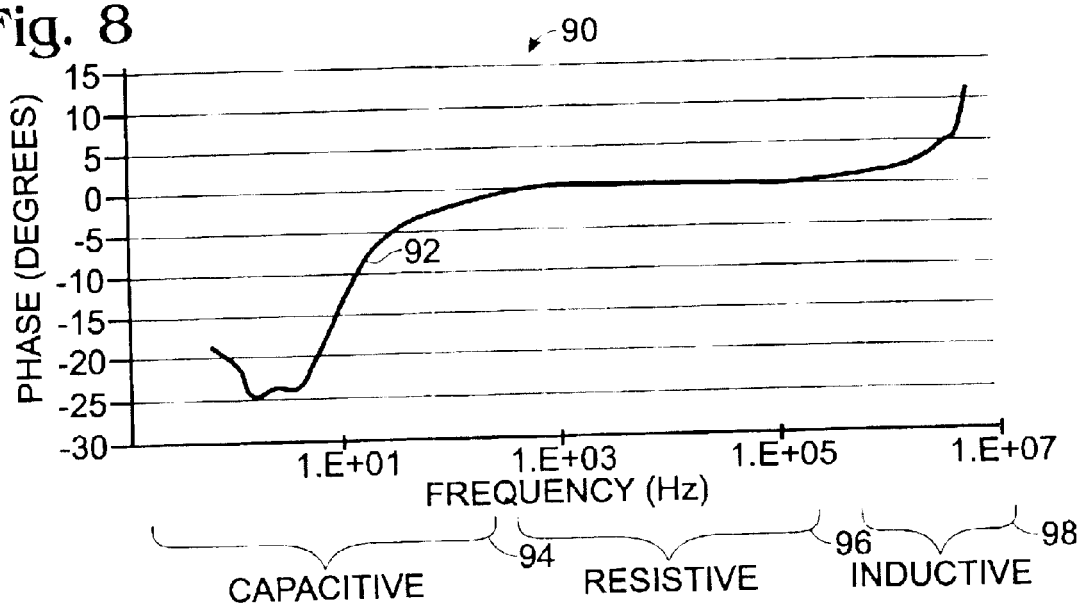
FIG. 8 is a graph showing a measured phase shift between $e_{in}$ and $e_{out}$ of the embodiment of FIG. 2 as a function of signal frequency.
Figure 9:
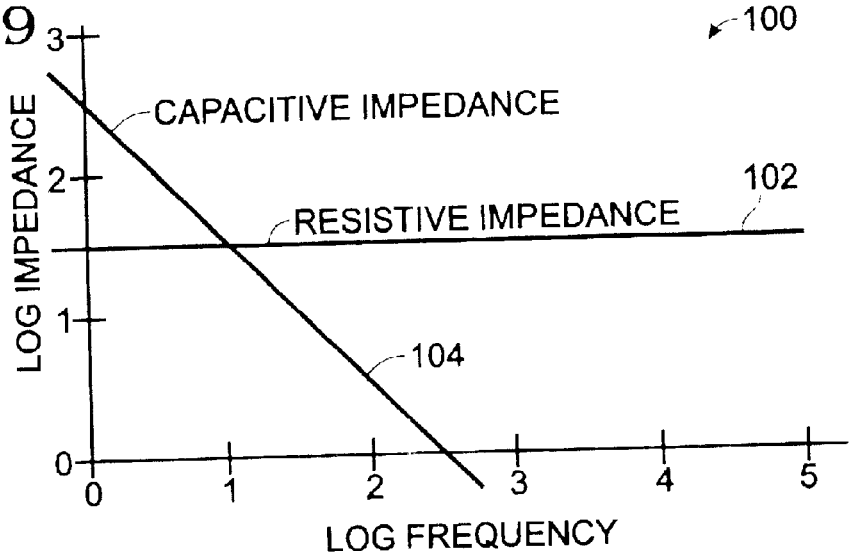
FIG. 9 is a log—log graph showing the relative contributions of capacitance and resistance to the total impedance of the embodiment of FIG. 2 as a function of signal frequency.

FIG. 8 shows, generally at 90, a graph depicting the observed phase shift of a signal in an exemplary printing fluid detector as a function of the log of the frequency of the signal. The data represented in graph 90 was taken from a printing fluid detector full of fluid. Line 92 is drawn through a plurality of data points (not shown) taken over a range of frequencies from approximately 1 Hz to approximately 1 MHz. The phase shift shows a first region 94 between approximately 1 Hz and approximately 1 kHz in which the phase shift varies significantly as a function of the frequency of the supply signal. Referring to FIG. 9, which shows a graph 100 illustrating the frequency dependence of the resistive component of the total impedance of the electrodes and printing fluid at 102 and the capacitive portion of the total impedance at 104, it can be seen that the capacitive portion dominates the total impedance at lower frequencies. Thus, the phase shift of the detected signal compared to the supply signal is expected to be greatest in this region.

Referring again to FIG. 8, the phase shift is seen to be essentially zero in a second, middle region 96 of graph 90, between approximately 1 kHz and 100 kHz. In this region, the capacitive and inductive portions of the impedance are negligible, while the resistive portion is dominant. Finally, the phase shift increases in a third, high-frequency region 98 of graph 90, above approximately 100 kHz. This phase shift is due to inductive effects. Thus, the capacitance of the printing fluid within conduit 28 may be measured most sensitively in capacitive frequency region 94, between approximately 1 Hz and 1 kHz. While the phase shift is expected to be greatest at low frequencies, the use of frequencies in the range of 50–100 Hz still give large phase shifts, and also may enable the more rapid acquisition of data. Furthermore, the use of lower frequencies (<1 Hz) may result in the plating of the electrodes with metal ions present in the printing fluid, whereas the use of higher frequencies may avoid the occurrence of plating.

Because the total capacitance of first electrode 32 and second electrode 34 is a function of the amount of charge stored on each electrode, the capacitance of the electrodes drops as the fluid level (and thus the size of each EDL) drops. This drop is relatively large where one of the electrodes is not in contact with printing fluid. Thus, an absence of printing fluid in conduit 28 may be observed as a relatively significant change in the phase shift between the supply signal measured at $e_{in}$ and the detected signal measured at $e_{out}$.

Figure 10:
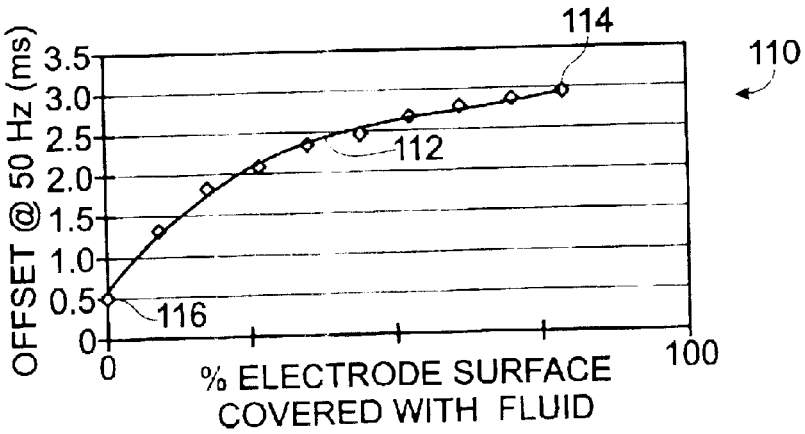
FIG. 10 is a graph showing a measured phase shift between $e_{in}$ and $e_{out}$ as a function of an amount of printing fluid between the electrodes.

FIG. 10 shows, generally at 110, a graph depicting the dependence of the phase shift 112 between the supply signal and the detected signal as a function of an amount of electrode surface area covered by printing fluid. Graph 110 shows the result of experiments performed with two electrodes in a vessel of printing fluid, but the graph may be used to extrapolate capacitances observed between a full-of-fluid condition and an out-of-fluid condition in conduit 28. The full-of-fluid condition corresponds to point 114, which shows a phase shift of approximately 3.0 ms, while an out-of-fluid condition corresponds approximately to point 116, which shows a phase shift of approximately 0.5 ms.

The magnitude of the phase shift at these printing fluid levels has been found to be accurately reproducible. This enables a look-up table of phase shifts associated with an absence or presence of printing fluid to be constructed and stored in memory 48. Thus, processor 46 may be programmed to match a measured phase shift value to phase shift values stored in the look-up table in memory 48 for both the "full of fluid" and out-of-fluid conditions, and then to determine the printing fluid level corresponding to the measured phase shift value. Processor 46 may then communicate this condition to printing device controller 22, which may stop printing or take other suitable action in response. Alternatively, a simple threshold filter circuit may be used to detect an out-of-fluid signal without the use of a look-up table, wherein capacitances above a preselected threshold value are considered to indicate the presence of printing fluid, and capacitances below the preselected threshold value (or a separate, lower preselected value) are considered to indicate the absence of printing fluid.

As described above, printing fluid detector 30 may be used to detect other printing fluid characteristics besides an out-of-fluid condition. For example, printing fluid detector 32 may be used to detect a printing fluid type. Different ionic printing fluids typically have different metal cations ions, organometallic ions, and counterions, and also typically have different concentrations of ions, depending upon the color (and other physical characteristics) of the printing fluid.

Figure 11:
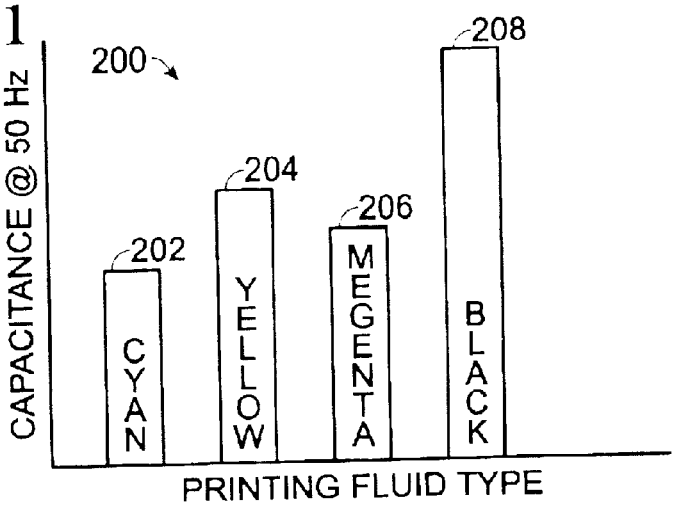
FIG. 11 is a graph showing measured capacitances for a plurality of different printing fluids at a selected frequency.

The presence of different ions and/or different concentrations of ions may cause the electrodes to exhibit different impedance characteristics in the presence of different types of fluids. FIG. 11 shows, generally at 200, a bar graph representing the relative magnitudes of the phase shifts (and thus the relative magnitudes of the capacitance of the electrodes) measured for four different printing fluids at a selected frequency. Cyan is shown at 202, yellow at 204, magenta at 206 and black at 208. Graph 200 shows that each printing fluid is distinguishable from the others across the entire frequency range by its respective measured phase shift/capacitance.

Due to the differences in the phase shifts between the different printing fluids, a printing fluid determination may be simple to implement using measured phase shift values. First, a predetermined phase shift value could be determined for each printing fluid supported by printing device 10. Next, a look-up table that contains a list of the printing fluids correlated to their predetermined phase shift values may be constructed and stored in memory 46. Finally, a phase shift value measured by printing fluid detector 30 for an unknown fluid may be compared to the phase shift values stored in the look-up table to determine which printing fluid corresponds to the measured phase shift value.

Given the wide variety of printing fluids available today, some printing fluids may exhibit phase shift values so similar that they are difficult to distinguish. To help reduce the possibility that a printing fluid is misidentified, more than one impedance characteristic may be measured for a selected printing fluid, and memory 46 may include a look-up table containing a list of printing fluids that are each correlated to more than one predetermined impedance characteristic. For example, printing fluid detector 32 may be configured to first measure a phase shift value, and then a resistance value, and then compare these values to predetermined phase shift and resistance values for selected printing fluids.

Figure 12:
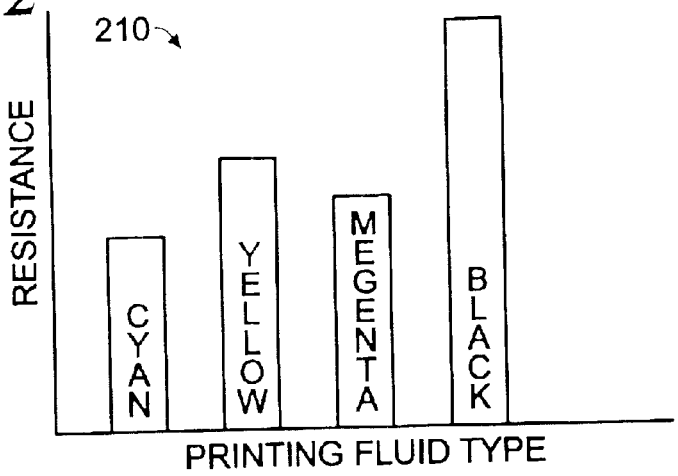
FIG. 12 is a graph showing measured resistances for a plurality of different printing fluids at a selected frequency.

Referring briefly back to FIGS. 8 and 9, at frequencies between approximately 1 kHz and 100 kHz, the capacitive component of the total impedance is essentially zero. Thus, the resistance of the printing fluid is the major component of the total impedance between these frequencies. It has been found that the printing fluid resistance may be accurately measured at these frequencies. Furthermore, it has been found that different printing fluids exhibit different fluidic resistances. Thus, the printing fluid resistance may be used to help identify a printing fluid type. A simple bar graph showing the variation in the magnitude of the resistance between the four printing fluids of FIG. 11 is shown generally at 210 in FIG. 12.

To implement a two-impedance-value measurement, a phase shift value may be measured at a first, lower frequency, and then a resistance value may be measured at a higher frequency. Next, processor 48 may look for a fluid in the look-up table in memory 46 that has impedance values which most closely match each of the impedance values measured for the printing fluid in the printing fluid reservoir. Alternatively, two different phase shift values may be measured at two different frequencies, and the look-up table may include two predetermined phase shift values for each fluid type. Furthermore, a phase shift and total impedance may be measured at a single frequency, and compared to corresponding values in a look-up table. It will be appreciated that these combinations of impedance values are merely exemplary, and that any other suitable combination of impedance values may be used in a printing fluid type determination.

The printing fluid resistance also may be used with any of the printing fluid detector embodiments described herein to determine an out-of-fluid condition. As described above, the fluidic resistance measurement may be made at a frequency between approximately 1 kHz and 100 kHz to reduce the capacitive component of the total impedance of the electrodes and the printing fluid. A resistance value may be determined by measuring the voltage drop at $e_{out}$ (of FIG. 2), combined with measuring the current flowing through the circuit. A resistor (not shown) may be used in parallel with the fluidic resistance to help in the calculation and/or measurement of the voltage drop. The measured resistance value could then be compared to a look-up table containing a plurality of pre-determined printing fluid levels correlated with predetermined fluidic resistance values to determine the printing fluid level, as described above for the phase shift embodiments.

The determination of printing fluid resistance values at frequencies between 1 kHz and 100 kHz has been found to be a quick and reliable method of determining printing fluid levels, printing fluid types and out-of-fluid conditions. Furthermore, the resistance measurements have been found to be sensitive to changes in fluid types and/or the presence/absence of fluid in the electrodes. Additionally, the resistance measurements have been found to allow the resistance of printing fluid to be distinguished from residual printing fluid froth of a wide range of densities and concentrations of froth that may be left in the printing fluid reservoir after the printing fluid has been emptied.

One difficulty that may be encountered in using capacitance/phase shift and/or resistance measurements to determine an out-of-fluid condition is that, for some printing fluids, the resistance and capacitance (and therefore, the phase shift) measurements of the fluid and residual froth may be dependent to various degrees upon the temperature of the printing fluid in the printing fluid reservoir. Ordinarily, the differences in the capacitance/resistance of the printing fluid and electrodes as compared to air is sufficiently different that any minor variations in the capacitance/resistance of the fluid as a function of temperature may not effect an out-of-fluid determination. However, in some situations, the residual froth left over inside of a printing fluid reservoir after the printing fluid reservoir is substantially emptied of printing fluid may have a resistance similar to the resistance of the printing fluid.

Figure 13:
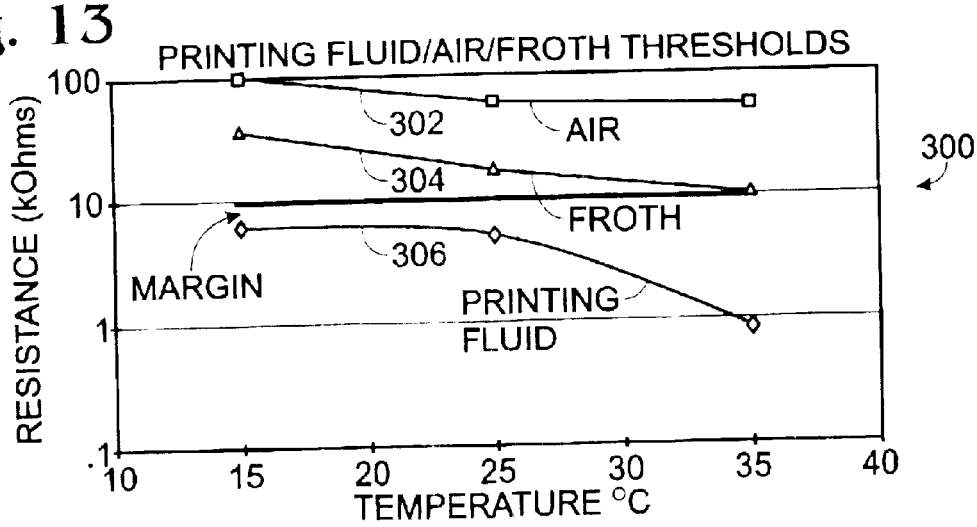
FIG. 13 is a graph showing the temperature dependence of resistance measurements for air, froth and printing fluid.

The resistances of air, froth and printing fluid in an exemplary printing fluid detector 30 are shown at 302, 304 and 306, respectively, in graph 300 of FIG. 13. Typically, it is desirable to indicate an out-of-fluid condition when only froth is present in the printing fluid reservoir. However, it can be seen that the margin between the resistance of froth at 35 degrees Celsius and the resistance of the printing fluid at 15 degrees Celsius is fairly narrow, and thus may be difficult for printing fluid detector 32 to distinguish.

To compensate, the following temperature calibration may be performed periodically to ensure that detector circuitry 44 is able to determine that a correct froth threshold is used for the actual temperature. First, the resistances of the printing fluid and froth are experimentally determined over a range of temperatures, and the determined values are recorded in a look-up table stored in memory 46. Next, a series of resistance measurements are taken, and the standard deviation of the measured values is determined. It has been found that a series of resistance measurements taken from a conduit containing froth has a much higher standard deviation (on the order of 100:1) than a series of resistance measurements taken from a conduit containing printing fluid, which consistently exhibits very low standard deviations. Thus, if the standard deviation (or other suitable mathematical indication of variability) of the series of resistance measurements is above a preselected threshold, for example, approximately 5%, then the printing fluid reservoir is determined to contain froth, and no temperature recalibration is performed. On the other hand, if the standard deviation of the series of resistance measurements is below the preselected threshold, then the printing fluid reservoir is determined to contain printing fluid, and the temperature corresponding to the measured printing fluid resistance is located in the look-up table. Finally, the froth resistance corresponding to the determined temperature is set as a new out-of-fluid threshold resistance value.

The resistance value corresponding to froth may be updated at any desired frequency. For example, the value may be updated as infrequently as once an hour, or even less frequently. Likewise, the value may be updated as frequently as once every few seconds. However, the value is more typically updated every few minutes. Updating the resistance value corresponding to froth every few minutes helps to ensure that the value is updated over a shorter timeframe than typical changes in temperature, yet is not updated so often as to consume printing device resources to a detrimental extent. The measurement of the resistance value corresponding to printing fluid may be facilitated, for example, by actuating a pump to remove froth from the vicinity of the first and second electrodes, where froth is detected.

Some printing devices may include a bipolar analog power supply that may be used to produce the alternating supply signal. However, other printing devices may not utilize bipolar voltages, but instead may only have a unipolar voltage source, such as a digital clock signal. The application of such a unipolar voltage source across the electrodes may cause metal ions to plate on the electrodes, which may result in the production of gasses. These gasses may be detrimental to the properties of the printing fluid, and also may cause unwanted pressure to build within printing fluid reservoir 26.

Figure 14:
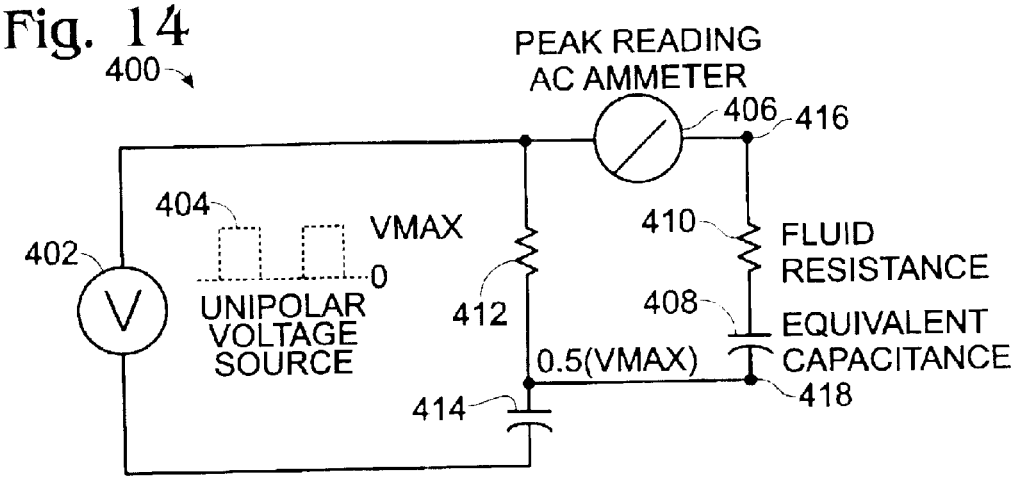
FIG. 14 is a schematic diagram of a first exemplary circuit suitable for producing a bipolar signal from a unipolar voltage source.
Figure 15:
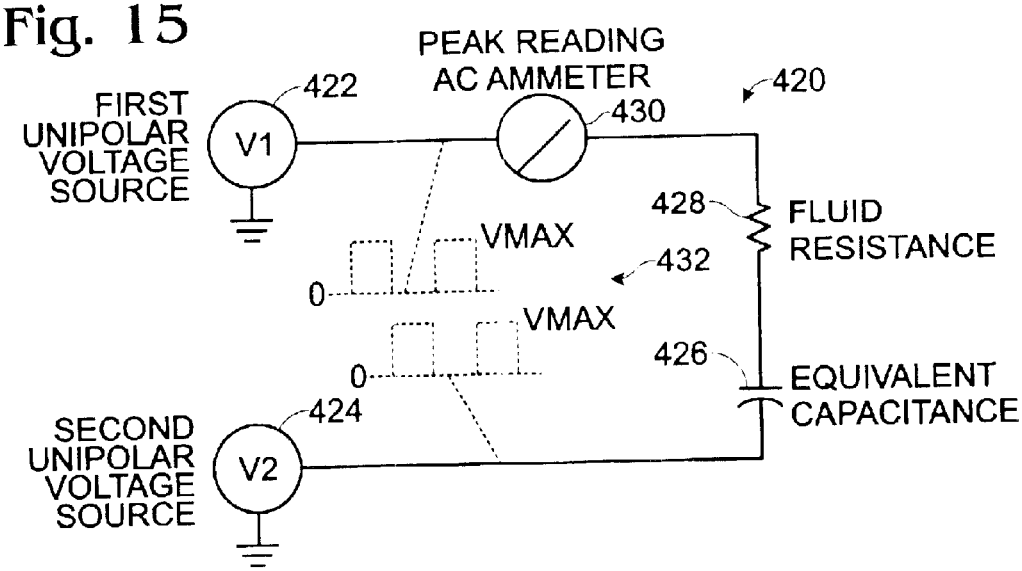
FIG. 15 is a schematic diagram of a second exemplary circuit suitable for producing a bipolar signal from a unipolar voltage source.

To avoid the expense of providing bipolar voltage sources in devices that would not otherwise have them, circuitry may be provided that creates a bipolar signal from a unipolar source. FIGS. 14 and 15 show two exemplary circuits that may be used to produce a bipolar voltage from one or more unipolar voltage sources.

First, FIG. 14 shows, generally at 400, a circuit that utilizes a single unipolar alternating voltage source 402 to generate a bipolar signal across the first and second electrodes. Voltage source 402 is configured to output a digital bi-level unipolar voltage, as shown in diagram 404. Capacitor 408 (labeled "equivalent capacitance"), and resistor 410 (labeled "fluid resistance") together represent the impedance of the first electrode, second electrode and printing fluid.

Circuit 400 also includes a peak reading AC ammeter 406 positioned below a junction at which the current splits to flow through resistor 412 and the electrodes and printing fluid to allow the calculation of an impedance value of the printing fluid. Circuit 400 also includes a resistor 412 in parallel with the fluidic impedance, and a capacitor 414 located below the junction at which the currents through resister 412 and the fluid resistance 410 rejoin. The values of resistor 412 and capacitor are 414 selected such that the RC time constant of capacitor 414 and resistor 412 is larger than the frequency of voltage source 402, and such that the voltage at capacitor 414 remains at approximately one half of the maximum output voltage of voltage source 402. Thus, when voltage source 402 is outputting a positive voltage, the voltage at point 416 is more positive than the voltage at point 418. On the other hand, when voltage source 402 is outputting 0 V, capacitor 414 holds point 418 at a more positive voltage than point 416. In this manner, the first and second electrodes alternate as the most positive electrode, helping to avoid plating and gas production problems.

Next, FIG. 15 shows a circuit 420 that utilizes two unipolar voltage sources to create a bipolar signal across the first and second electrodes. Circuit 420 includes a first unipolar voltage source 422 connected to one electrode, and a second unipolar voltage source 424 connected to the other electrode. The impedance of the first electrode, second electrode and printing fluid is represented by capacitor 426 (labeled "equivalent capacitance") and resistor 428 (labeled "fluid resistance"). Circuit 420 may include an ammeter 430 to allow the current through the electrodes and printing fluid to be measured, and thus to allow a measured impedance value to be calculated.

The signals supplied by voltage sources 422 and 424 are configured to be 180 degrees out of phase, as shown in phase diagram 432. Thus, whenever the signal from voltage source 422 is high, the signal from voltage source 424 is low and vice versa. This causes the polarities of the two electrodes to be reversed periodically, and thus helps to avoid plating problems and unwanted production of gases in the printing fluid reservoir.

Figure 16:
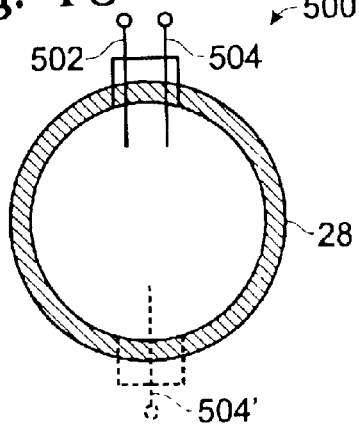
FIG. 16 is a sectional, schematic depiction of an exemplary embodiment of a pair of electrodes suitable for use with the printing fluid detector of the embodiment of FIG. 1, with an alternate electrode position shown in dashed lines.

Other electrode configurations besides cylindrical electrodes may be used in printing fluid detector 30. FIGS. 16–19 show two other exemplary embodiments of electrodes printing fluid detector 30. First, FIG. 16 shows generally at 500 printing fluid detector circuitry that includes a first electrode 502 and a second electrode 504 in the form of narrow, elongate electrically conductive members that protrude into the interior of conduit 28. The electrically conductive materials that form first electrode 502 and second electrode 504 are configured to be in direct contact with printing fluid inside of conduit 28. Thus, even though first electrode 502 and second electrode 504 may have relatively small surface areas, the electrodes display large capacitances due to the EDL effect. It will be appreciated that the circuitry described above in reference to FIGS. 2–3 may be used with electrodes 502 and 504 by replacing the cylindrical electrodes in those figures with electrodes 502 and 504.

First electrode 502 and second electrode 504 may have any suitable length. For example, first electrode 502 and/or second electrode 504 may extend either completely across or only partially across the inner diameter of conduit 28. Additionally, the electrodes may have any suitable diameter, ranging from a thin, needle-like shape to a thicker shape that substantially fills the interior of conduit 28. Furthermore, the electrodes may be arranged within conduit 28 in any suitable manner. For example, the electrodes may be arranged side-by-side across conduit 28 (in a direction either across the direction of fluid flow, as shown, or along the direction of fluid flow), at opposite sides of conduit 28 (as indicated by second electrode 504', shown in dashed lines), or in any other suitable relation. The magnitude of the EDL effect allows the electrodes to be widely separated and still sensitively measure impedance characteristics of printing fluids in conduit 28.

Figure 17:
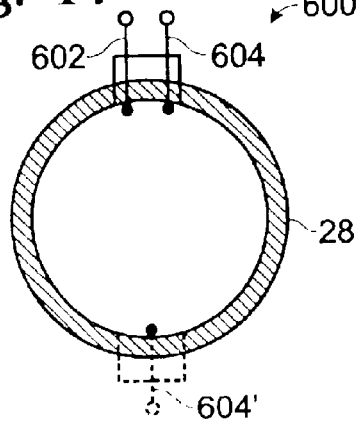
FIG. 17 is a sectional, schematic depiction of another exemplary embodiment of a pair of electrodes suitable for use with the printing fluid detector of the embodiment of FIG. 1, with an alternate electrode position shown in dashed lines.

Next, FIG. 17 shows, generally at 600, an exemplary embodiment of printing fluid detector circuitry that includes smaller, nub-like first 602 and second 604 electrodes. First electrode 602 and second electrode 604 as depicted have a smaller surface area than electrodes 502 and 504 of FIG. 16. However, due to the EDL effect, electrodes 602 and 604 still exhibit large capacitances in the presence of printing fluid, and thus may be used to measure impedance characteristics of a printing fluid in conduit 28 with a high degree of sensitivity.

Electrodes 602 and 604 may each have any suitable shape and size. For example, rather than the small, nub-like electrodes depicted in FIG. 17, electrodes 602 and 604 may be recessed into the interior wall of conduit 28 such that the electrode protrudes less into the interior of the conduit, or is flush with the interior wall of the conduit. Likewise, electrodes 602 and 604 may be positioned in any desired relation to each other. For example, electrodes 602 and 604 may be positioned in a side-by-side manner, or one electrode (indicated at 604') may be positioned opposite the other electrode. It will be appreciated that a nub-shaped electrode, such as those depicted in FIG. 17, may be used in combination with an elongate electrode, such as those depicted in FIG. 16

Figures 18, 19:
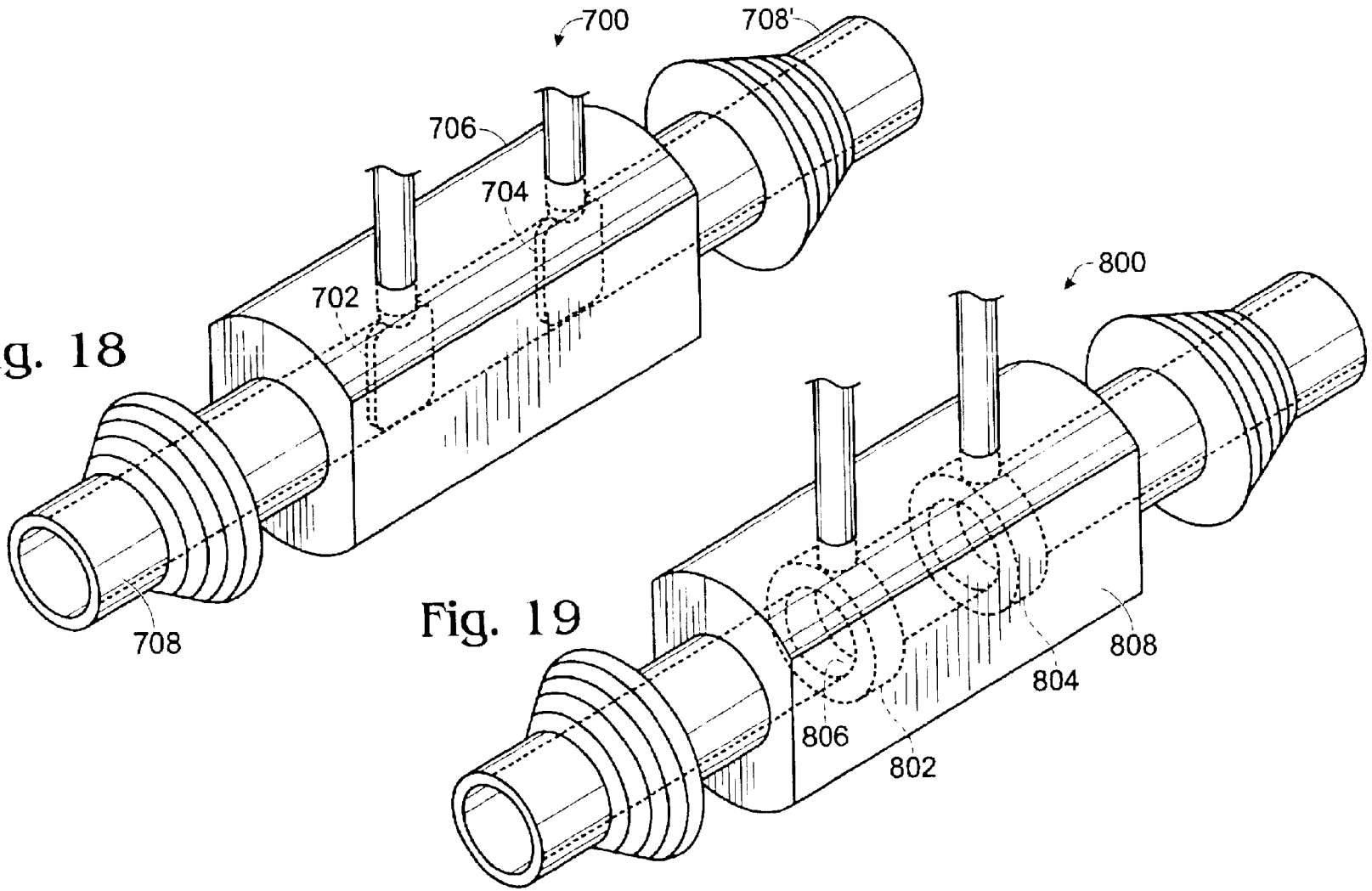
FIG. 18 is an isometric depiction of another exemplary embodiment of a pair of electrodes suitable for use with the printing fluid detector of the embodiment of FIG. 1.
FIG. 19 is an isometric depiction of another exemplary embodiment of a pair of electrodes suitable for use with the printing fluid detector of the embodiment of FIG. 1.

FIGS. 18 and 19 show other examples of suitable electrodes for detecting printing fluid in conduit 28. First, FIG. 18 shows, generally at 700, an exemplary embodiment of printing fluid detector circuitry that includes electrodes 702 and 704 with a relatively flat, wide cross-sectional circumference. Electrodes 702 and 704 are shown as extending entirely through conduit 28, but it will be appreciated that the electrodes may also extend only partially through the conduit. Also, while electrodes 702 and 704 are shown as having the long dimension of the cross-sectional circumference aligned with the direction of fluid flow through conduit 28, it will be appreciated that the electrodes may have any other suitable orientation.

If desired, electrodes 702 and 704 may be integrated with, or otherwise coupled to, a casing 706 that forms part of conduit 28. Casing 706 may include connectors 708 and 708' configured to allow the casing to be easily connected to and/or removed from adjacent segments of conduit 28. This may allow electrodes 702 and 704 to be more easily serviced and/or replaced. Alternatively, electrodes 702 and 704 may be configured to be coupled with a conduit segment other than casing 706.

FIG. 19 shows, generally at 800, yet another exemplary embodiment of printing fluid detector circuitry that includes ring-shaped electrodes 802 and 804. Each ring-shaped electrode 802 and 804 includes an opening 806 through which printing fluid may flow. Electrodes 802 and 804 may be integrated with, or otherwise coupled to, a casing 808 configured to be easily connected to and removed from other segments of conduit 28. Alternatively, electrodes 802 and 804 may be configured to be coupled with a conduit segment other than casing 808.

As mentioned above, printing fluid may be transferred from printing fluid reservoir 26 to print head assembly 12 via a pumping mechanism. Where the pumping rate of the pumping mechanism and an initial level of printing fluid in printing fluid reservoir 26 are known, an actual fluid level of printing fluid in reservoir 26 may be calculated. First, when pumping is initiated, the temperature calibration described above for determining the air/froth threshold resistance value may be performed. Next, if printing fluid detector 30 determines that pumping fluid, as opposed to froth, is in conduit 28, the length of time that the pumping mechanism transfers fluid out of printing fluid reservoir 26 may be monitored. Once pumping is completed (or periodically during pumping), the amount of fluid that has been transferred out of printing fluid reservoir 26 may be calculated by multiplying the pumping rate and the pumping time. Finally, the amount of fluid transferred may be subtracted from the initial amount of fluid to determine an amount of printing fluid remaining in printing fluid reservoir 26, which may then be stored in memory 46. This value may then be used as the initial printing fluid amount in a subsequent calculation of printing fluid usage.

This technique of monitoring printing fluid usage may be extended to situations in which froth is being transferred to print head assembly 12 instead of pure printing fluid. Printing fluid froth is typically a mixture of printing fluid and air or other gases. It has been found that the resistance of froth measured by printing fluid detector 30 in the 1 kHz–100 kHz frequency range varies linearly with the fluid content of the froth. Therefore, a look-up table may be constructed by measuring the resistance of froth over a range of air:printing fluid ratios for a selected printing fluid, and then stored in memory 26. Then, as printing fluid or froth is transferred from printing fluid reservoir 26 to print head assembly 12, the amount of printing fluid transferred may be determined first by measuring the resistance of the printing fluid and/or froth in printing fluid detector 30, then comparing the measured resistance to the resistance values stored in the look-up table to determine the fluid:air ratio of the fluid and/or froth in the printing fluid detector, and then calculating how much fluid is transferred by multiplying the pumping time, the pumping rate, and the measured fluid:air ratio.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A printing device configured to print a printing fluid onto a printing medium, comprising:

a printing fluid reservoir configured to hold a volume of the printing fluid;

a print head assembly configured to transfer the printing fluid to the printing medium;

a conduit fluidically connecting the printing fluid reservoir to the print head assembly; and a printing fluid detector associated with the conduit, wherein the printing fluid detector includes a first electrode and a second electrode configured to be in contact with printing fluid in the conduit, a power supply configured to apply an alternating supply signal to the first electrode, and detector circuitry configured to measure a plurality of measured impedance values related to the presence of printing fluid within the conduit by comparing the alternating supply signal with a plurality of detected signals that have been modified from the applied signal by an impedance characteristic of the printing fluid, to determine a variability of the plurality of measured impedance values, and if the variability of the plurality of measured impedance values is equal to or below a predetermined variability, then to determine a temperature of the printing fluid based upon the plurality of measured impedance values.

2. The printing device of claim 1, wherein the printing fluid detector is configured to determine a threshold out-of-fluid impedance value from the temperature of the printing fluid.

3. The printing device of claim 1, wherein at least one of the first electrode and the second electrode includes an electrically conductive conduit segment.

4. The printing device of claim 3, wherein the first electrode includes a first electrically conductive conduit segment, wherein the second electrode includes a second electrically conductive conduit, and wherein the first electrically conductive conduit segment is separated from the second electrically conductive conduit segment by an electrically insulating conduit segment.

5. The printing device of claim 3, wherein the electrically conductive conduit segment has an internal diameter of between approximately 0.5 and 5.0 millimeters.

6. The printing device of claim 3, wherein the first electrically conductive conduit segment and the second electrically conductive conduit segment are disposed within a housing that holds the first electrically conductive conduit segment and the second electrically conductive conduit segment in position relative to one another.

7. The printing device of claim 6, wherein the housing substantially encloses the first electrically conductive conduit segment and the second electrically conductive conduit segment.

8. The printing device of claim 6, wherein the housing includes an electrically insulating separator that separate the first electrically conductive conduit segment end the second electrically conductive conduit segment.

9. The printing device of claim 1, wherein at least one of the first electrode and the second electrode has an elongate configuration that protrudes into an inner volume of the conduit.

10. The printing device of claim 9, wherein at least one of the first electrode and the second electrode has a narrow, elongate configuration that extends into an interior portion of the conduit.

11. The printing device of claim 1, wherein at least one of the first electrode and the second electrode has a nub-like configuration.

12. The printing device of claim 1, wherein at least one of the measured impedance values is a resistance value of the printing fluid.

13. The printing device of claim 12, wherein the alternating supply signal has a frequency of between approximately 1 kHz and 100 kHz.

14. The printing device of claim 1, wherein at least one of the measured impedance values is a phase shift between the alternating supply signal and a detected signal detected at the first electrode.

15. The printing device of claim 14, wherein the alternating supply signal has a frequency of between approximately 1 kHz and 1 kHz.

16. The printing device of claim 1, wherein the detector circuitry includes a processor operatively linked to a memory containing a set of instructions executable by the processor to compare the plurality at measured impedance values to a plurality of predetermined impedance values stored in the memory and correlated with specific printing fluid temperatures to determine the temperature of the printing fluid.

17. The printing device of claim 16, wherein the instructions are executable by the processor to measure a set of at least two measured impedance values after determining the temperature of the printing fluid, and to compare a the set of at least two measured impedance values to a plurality of predetermined sets of at least two impedance values stored in the memory and correlated with specific printing fluids to identify the printing fluid.

18. The printing device of claim 17, wherein the set of at least two measured impedance values includes a measured printing fluid resistance and a measured printing fluid capacitance.

19. The printing device of claim 18, wherein the measured printing fluid resistance and measured printing fluid capacitance are measured at different frequencies.

20. The printing device of claim 17, wherein the set of at least two measured impedance values includes a phase shift measured at a first frequency and a phase shift measured at a second frequency.

21. The printing device of claim 1, wherein the detector circuitry includes a processor operatively linked to a memory containing a set of instructions executable by the processor to measure another measured impedance value after determining the temperature of the printing fluid, and to compare the another measured impedance value to the threshold out-of-fluid impedance value to determine an out-of-fluid state.

22. The printing device of claim 1, wherein the printing fluid is an ionic printing fluid.

23. The printing device of claim 1, wherein the electrodes are coated with an electrically conductive polymer film.

24. The printing device of claim 23, wherein the electrically conductive polymer film is selected from the group consisting of polypyrroles, polyanilines, polythiophenes, conjugated bithiazoles and bis-(thienyl) bithiazoles.

25. The printing device of claim 1, wherein the electrodes are at least partially made of material selected from the group consisting of stainless steel, platinum, gold, palladium, activated carbon, carbon black, carbon fiber cloth, graphite, graphite powder, graphite cloth, glassy carbon, carbon aerogel, and cellulose-derived foamed carbon.

26. A printing device configured to print a printing fluid onto a printing medium, comprising:

a printing fluid reservoir configured to hold a volume of the printing fluid;

a print head assembly configured to transfer the printing fluid to the printing medium;

a conduit fluidically connecting the printing fluid reservoir to the print head assembly, wherein the conduit includes a first electrically conductive conduit segment and a second electrically conductive conduit segment separated by an electrically insulating conduit segment;

an alternating signal source electrically connected to the first and second electrically conductive conduit segments, wherein the alternating signal source is configured to apply an alternating supply signal across the first and second electrically conductive conduit segments; and a detector circuit electrically connected to the first and second electrically conductive conduit segments, wherein the detector circuit is configured to detect a measured impedance value related to the printing fluid within the conduit.

27. The printing device of claim 26, wherein at least one of the first and second electrically conducting conduit segments has a generally cylindrical shape.

28. The printing device of claim 27, wherein the first electrically conductive conduit segment and the second electrically conductive conduit segment are disposed within a housing that holds the first electrically conductive conduit segment and the second electrically conductive conduit segment in position relative to one another.

29. The printing device of claim 28, wherein the housing substantially encloses the first electrically conductive conduit segment and the second electrically conductive conduit segment.

30. The printing device of claim 26, wherein at least one of the first and second electrically conducting conduit segments includes an interior passage having a width of between approximately 0.5 and 1.5 millimeters.

31. The printing device of claim 26, wherein the detector circuit is configured to compare the alternating supply signal to a detected signal detected at one of the first electrode and the second electrode to determine a phase shift between the alternating supply signal and detected signal.

32. The printing device of claim 31, wherein the alternating supply signal has a frequency of between approximately 1 Hz and 1 kHz.

33. The printing device of claim 26, wherein the detector circuit is configured to compare the alternating supply signal at the first electrode to a detected signal at the first electrode to determine a resistance of at least one of liquid printing fluid and printing fluid froth in the conduit.

34. The printing device of claim 33, wherein the alternating supply signal has a frequency of between approximately 1 kHz and 100 kHz.

35. The printing device of claim 26, wherein the detector circuitry includes a processor operatively linked to a memory containing a set of instructions executable by the processor to compare the measured impedance value to a plurality of predetermined impedance values stored in the memory and correlated with specific printing fluids to identify the printing fluid.

36. The printing device claim 35, wherein the instructions are executable by the processor to compare a set of at least two measured impedance values of the printing fluid to a plurality of sets of at least two predetermined impedance values stored in the memory and correlated with specific printing fluids to the printing fluid.

37. The printing device of claim 36, wherein the set of at least two measured impedance values includes a measured printing fluid resistance and a measured printing fluid capacitance.

38. The printing device of claim 36, wherein the set of at least two measured impedance values includes a phase shift measured at a first frequency and a phase shift measured at a second frequency.

39. The printing device of claim 26, wherein the detector circuitry includes a processor operatively linked to a memory containing a set of instructions executable by the processor to compare the measured impedance value to a plurality of predetermined impedance values stored in the memory and correlated with a presence or an absence of printing fluid in the conduit to determine an out-of-fluid state.

40. The printing device of claim 39, wherein the detector circuitry is configured to determine that froth exists between the first electrode and the second electrode if the variability is greater than or equal to the predetermined variability.

41. The printing device of claim 40, further comprising a pump configured to pump fluid through the conduit if the detector circuitry determines that froth exists between the first electrode and the second electrode.

42. A printing device, comprising:

a printing fluid reservoir configured to hold a volume of a printing fluid;

a print head assembly configured to transfer the printing fluid to a printing medium;

a conduit fluidically connecting the printing fluid reservoir to the print heed assembly;

a first electrode extending inside of the conduit;

a second electrode extending inside of the conduit;

an alternating signal source configured to apply an alternating supply signal to the first electrode; and detector circuitry electrically connected to the first electrode and the second electrode to detect a plurality of measured impedance values related to the printing fluid within the conduit, to determine a variability of the plurality of measured impedance values, and if the variability of the plurality of measured impedance values has a preselected relationship to a predetermined variability, then to determine a temperature of the printing fluid based upon the plurality of measured impedance values.

43. The printing device of claim 42, wherein the predetermined relationship is equal to or less than the predetermined variability.

44. The printing device of claim 43, wherein the detector circuitry is configured to determine a threshold out-of-fluid impedance value corresponding to the temperature of the printing fluid if the variability is less than or equal to the predetermined variability.

45. The printing device of claim 42, wherein the detector circuitry is configured to detect a detected signal that has been modified from the supply signal by an impedance characteristic of the printing fluid, and to determine a measured phase shift between the supply signal and the detected signal.

46. The printing device of claim 45, wherein the detector circuitry includes a processor operatively linked to a memory containing a set of instructions executable by the processor to compare the measured phase shift to a plurality of predetermined phase shifts stored in the memory and correlated with specific printing fluids to identify the printing fluid.

47. The printing device of claim 45, wherein the detector circuitry includes a processor operatively linked to a memory containing a set of instructions executable by the processor to compare the measured phase shift to a plurality of predetermined phase shifts stored in the memory and correlated with a presence and an absence of printing fluid to determine an out-of-fluid state.

48. The printing device of claim 42, wherein the detector circuitry is configured to detect a detected signal that has been modified by an impedance characteristic of the printing fluid, end to determine a measured resistance of printing fluid in the conduit by comparing the detected signal to the supply signal.

49. The printing device or claim 48, wherein the detector circuitry includes a processor operatively linked to a memory containing a set of instructions executable by the processor to compare the measured resistance to a plurality of predetermined resistances stored in the memory and correlated with specific printing fluids to identity the printing fluid.

50. The printing device of claim 48, wherein the detector circuitry includes a processor operatively linked to a memory containing a set of instructions executable by the processor to compare the measured resistance to a plurality of predetermined resistances stored in the memory and correlated with a presence and an absence of printing fluid to determine an out-of-fluid state.

51. In a printing device having a printing fluid reservoir configured to hold a volume of printing fluid, a print head assembly configured to transfer the printing fluid to a printing medium, a conduit fluidically connecting the printing fluid reservoir and the print head assembly, and first and second electrodes configured to be in contact with printing fluid in the conduit, a method of monitoring printing fluid in the conduit, the method comprising:

applying an alternating supply signal to the first and second electrodes via a power supply;

detecting a plurality of detected signals at one of the first and second electrodes;

determining a plurality of measured impedance values associated with the presence of the printing fluid in the conduit by comparing the plurality of detected signals to the supply signal;

determining a statistical variability of the plurality of measured impedance values; and if the statistical variability has a preselected relationship to a predetermined statistical variability threshold, then determining another measured impedance value and comparing the another measured impedance value to a plurality of previously determined impedance values correlated to known printing fluid conditions to determine at least one of a type of printing fluid and an out-of-fluid condition.

52. The method of claim 51, wherein determining each measured impedance value includes determining a measured phase shift between the supply signal and each detected signal.

53. The method of claim 52, wherein the supply signal has a frequency of between approximately 1 Hz and 1 kHz.

54. The method of claim 52, wherein the measured phase shift is compared to a plurality of previously determined phase shifts correlated to specific printing fluids to determine the type of printing fluid in the conduit.

55. The method of claim 52, wherein the measured phase shift is compared to a plurality of previously determined phase shifts correlated to a presence and an absence of printing fluid to determine whether printing fluid is present in the conduit.

56. The method of claim 51, wherein determining a plurality of measured impedance values includes determining a measured resistance across the first electrode and the second electrode for at least one of the plurality of the detected signals.

57. The method of claim 56, wherein the supply signal has a frequency of between approximately 1 kHz and 100 kHz.

58. The method of claim 56, wherein the measured resistance is compared to a plurality of previously determined resistances correlated to specific printing fluids to determine a type of printing fluid in the conduit.

59. The method of claim 56, wherein the measured resistance is compared to a plurality of previously determined resistances correlated to a presence or an absence of printing fluid to determine whether printing fluid is present in the conduit.

60. The method of claim 51, wherein determining another measured impedance value includes determining a set of at least two measured impedance values related to the printing fluid in the conduit, and wherein comparing the comparing the measured impedance value to a plurality of previously determined impedance values includes comparing the set of at least two measured impedance values to a plurality of sets of at least two impedance values correlated to known printing fluid conditions.

61. The method of claim 60, wherein the set of at least two measured impedance values includes a resistance measurement taken at a lower frequency and a resistance measurement taken at a higher frequency.

62. The method of claim 60, wherein the set of at least two measured impedance values includes a phase shift value measured at and a phase shift value measured at a higher frequency.

63. The method of claim 60, wherein the set of at least two measured impedance values includes a resistance measurement and a phase shift measurement.

64. The method of claim 51, wherein the printing device includes a pump for transporting fluid through the conduit, further comprising determining a printing fluid level by calculating a pumping rate at which the pump transfers printing fluid from the printing fluid reservoir, determining whether printing fluid is in the conduit, and if printing fluid is in the conduit, determining an amount of printing fluid pumped from the printing fluid reservoir by multiplying the pumping rate and a pumping time.

65. The method of claim 64, further comprising determining a level of printing fluid in the reservoir by subtracting the amount of printing fluid pumped from the printing fluid reservoir from an initial level of printing fluid in the printing fluid reservoir.

66. A printing device configured to print a printing fluid onto a printing medium, comprising:

a printing fluid reservoir configured to hold a volume of the printing fluid;

a print head assembly configured to transfer the printing fluid to the printing medium;

a conduit fluidically connecting the printing fluid reservoir to the print head assembly; and a printing fluid detector associated with the conduit, wherein the printing fluid detector includes a first electrode and a second electrode coupled with the conduit and configured to be in contact with printing fluid in the conduit, a power supply configured to apply an alternating supply signal to the first electrode, and detector circuitry configured to detect a measured impedance value related to the presence of printing fluid within the conduit by comparing the alternating supply signal with a detected signal that has been modified from the applied signal by an impedance characteristic of the printing fluid, wherein at least one of the first electrode and the second electrode includes an electrically conductive conduit segment, and wherein the electrically conductive conduit segment includes a barbed end configured to fit within an adjacent electrically insulating conduit segment.

67. A printing device configured to print a printing fluid onto a printing medium, comprising:

a printing fluid reservoir configured to hold a volume of the printing fluid;

a print head assembly configured to transfer the printing fluid to the printing medium;

a conduit fluidically connecting the printing fluid reservoir to the print head assembly, wherein the conduit includes a first electrically conductive conduit segment and a second electrically conductive conduit segment separated by an electrically insulating conduit segment;

an alternating signal source electrically connected to the first and second electrically conductive conduit segments, wherein the alternating signal source is configured to apply an alternating supply signal across the first and second electrically conductive conduit segments; and a detector circuit electrically connected to the first and second electrically conductive conduit segments, wherein the detector circuit is configured to detect a measured impedance value related to the printing fluid within the conduit, wherein at least one of the first and second electrically conducting conduit segments has a generally cylindrical shape, and wherein at least one of the first and second electrically conducting conduit segments includes a barbed end configured to fit within the electrically insulating conduit segment.

* * * * *

UNITED STATES PATENT AND TRADEMARK OFFICE

CERTIFICATE OF CORRECTION

PATENT NO. : 6,874,861 B2
APPLICATION NO. : 10/425788
DATED : April 5, 2005
INVENTOR(S) : Farr et al.

It is certified that error appears in the above-identified patent and that said Letters Patent is hereby corrected as shown below:

Col. 15 (line 7), delete "end" and insert therefor --and--.

Col. 15 (line 32), delete "1 kHz and 1 kHz." and insert therefor --1 kHz and 1 Hz.--

Signed and Sealed this

Twenty-second Day of August, 2006

JON W. DUDAS
*Director of the United States Patent and Trademark Office*